US006516725B2

(12) United States Patent
Jackson et al.

(10) Patent No.: US 6,516,725 B2
(45) Date of Patent: Feb. 11, 2003

(54) FORCE AMPLIFYING INITIATING DEVICE

(75) Inventors: Frederick Alexander Jackson, Diep Rivier (ZA); John Hofmeyr Godsiff, Fish Hoek (ZA)

(73) Assignee: Denel (Proprietary) Limited, Erasmuskloof (ZA)

( * ) Notice: Subject to any disclaimer, the term of this patent is extended or adjusted under 35 U.S.C. 154(b) by 0 days.

(21) Appl. No.: 09/929,525

(22) Filed: Aug. 14, 2001

(65) Prior Publication Data

US 2002/0050223 A1 May 2, 2002

(30) Foreign Application Priority Data

Aug. 14, 2000 (ZA) ..... 2000/4133

(51) Int. Cl.[7] ..... F42B 5/32

(52) U.S. Cl. ..... 102/471; 102/204; 102/275.6; 102/702

(58) Field of Search ..... 102/204, 275, 102/275.6, 322, 470, 471, 702

(56) References Cited

U.S. PATENT DOCUMENTS 3,971,319 A * 7/1976 Larson ..... 102/204
4,037,537 A * 7/1977 Thorsell et al. ..... 102/322
4,099,465 A * 7/1978 Haake ..... 102/204
4,632,034 A * 12/1986 Colle, Jr. ..... 102/322
4,817,530 A * 4/1989 Florin ..... 102/322
5,157,219 A * 10/1992 Calsson et al. ..... 102/204
5,789,694 A * 8/1998 Mey ..... 102/471

FOREIGN PATENT DOCUMENTS

AU 653820 * 12/1992 ..... 102/204

* cited by examiner

*Primary Examiner*—Harold J. Tudor
(74) *Attorney, Agent, or Firm*—Ladas & Parry

(57) ABSTRACT

A cartridge assembly 10 includes a shell 12 containing a propellant charge 19. At a rear, open end, the shell 12 holds a force amplifying initiating device 20, in turn holding a rim fire primer 22 in operative association with the propellant 19. A firing pin body 40 is movably held within the device 40 to expose a rear of the body 40 to a shock wave to initiate the device 20. A fore end of the body 40 includes a taper formation 48 having a rounded fore point 50 aligned with an inactive surface of the primer 22 centrally within a firing rim. Inadvertent (mechanical) actuation of the firing pin 40 will fall to cause sufficient and sufficiently fast impingement on the primer to initiate the primer. Only a shock wave can cause initiation. The primer 22 is held in a collar 34 allowing it to flare open upon initiation and holding it within the shell 12 after initiation.

8 Claims, 1 Drawing Sheet

FORCE AMPLIFYING INITIATING DEVICE

Figure 1:
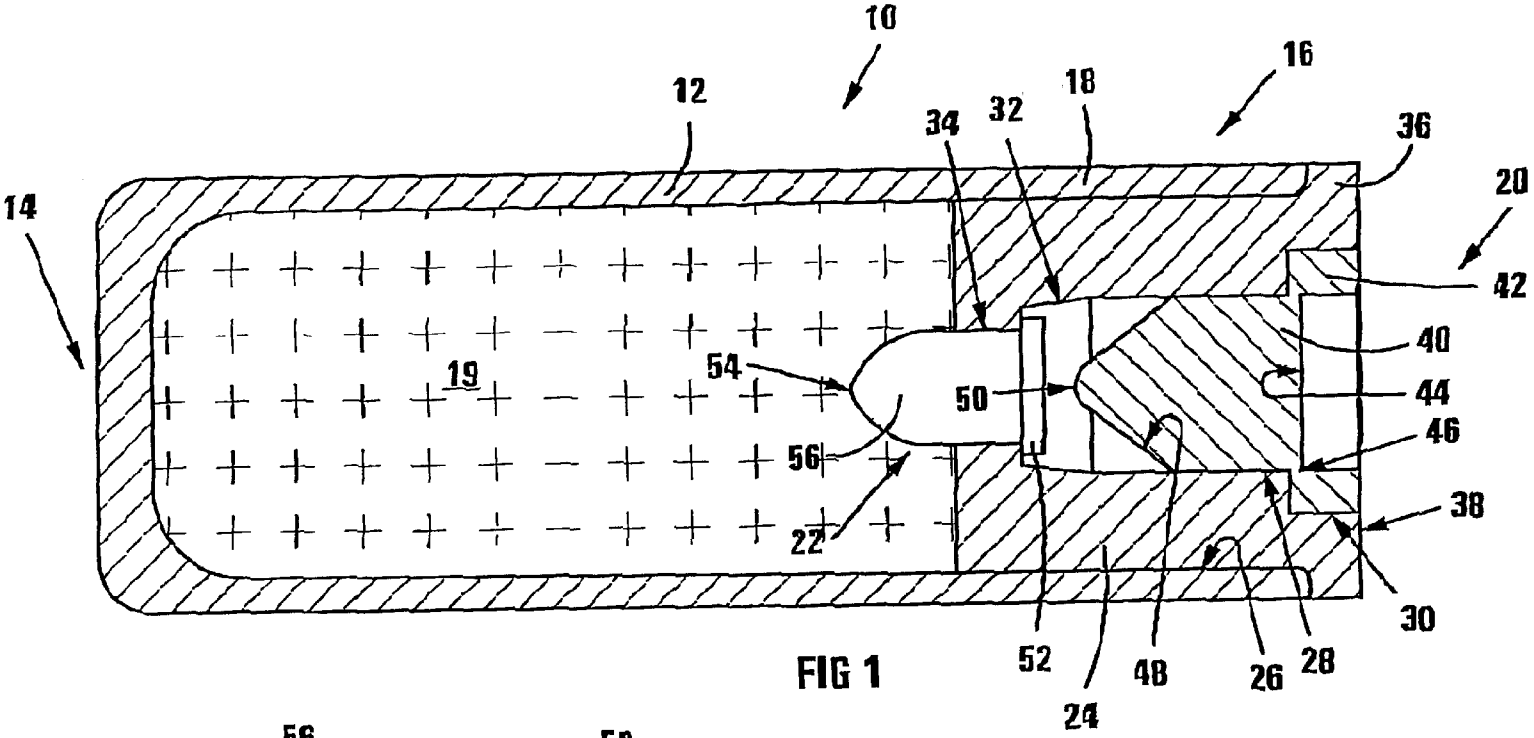

THIS INVENTION relates to a force amplifying initiating device for a cartridge. It relates also to a cartridge including a force amplifying initiating device.

A force amplifying initiating device of the kind to which this invention relates, includes a body having first and second open ends and a firing pin arrangement held within the body such as to be operatively exposed to its surroundings via the first open end. The body is, in use, located to a cartridge shell such that the firing pin is operatively aligned with a primer of the cartridge via the second open end. In use, when the cartridge is to be fired, the first open end of the force amplifying initiating device is subjected to a pressure pulse or shock wave which actuates the firing pin to initiate the primer.

For purposes of this invention, a force actuating initiating device as described will be referred to as an initiating device.

The Applicant believes that an initiating device in accordance with this invention will advantageously be usable for firing a cartridge placed in a remote location or a location which is difficult to obtain access to. For example, in the breaking of rock and the like, it is known to place a rock breaking cartridge in a hole drilled into the rock, and to fire the cartridge. Advantageously, the hole may be filled with a medium, such as water, a gel, or the like, which propagates pressure pulses or shock waves well. This is referred to in the field of rock breaking as a "down the hole" cartridge or "down the hole" rock breaking. Although this invention is not limited to "down the hole" applications, it is expected to be used extensively in such applications.

In accordance with a first aspect of this invention, there is provided a force amplifying initiating device suitable for use to initiate a primer of a cartridge in response to a pressure pulse or shock wave, the initiating device comprising an open ended body having a fore opening and a rear opening and a locating formation for locating the body to a cartridge in a predetermined relation to a primer of the cartridge;

a firing pin having a fore operative end and a rear end, and being movably contained in the body such that said fore operative end is in alignment with the primer via said fore opening of the body and such that said rear end is exposed via said rear opening of the body, in which said fore operative end is appropriate to initiate a rim fire primer having an initiating rim of predetermined effective diameter, said fore operative end tapering from a rear base to a fore point, the rear base having a transverse dimension at least commensurate with the effective diameter of the initiating rim of the primer and the fore point having a transverse dimension smaller than the effective diameter of the initiating rim of the primer.

The fore operative end of the firing pin may be round, said transverse dimension of the base being the diameter of the base, and the transverse dimension of the point being the diameter of the point.

The fore operative end of the firing pin may be generally conical, the point being rounded.

An included angle of the generally conical fore operative end may be between 160° and 40°, preferably between 100° and 60°, most preferably about 70°.

In accordance with a second aspect of this invention, there is provided a combination of a force amplifying initiating device as herein described and a primer for a cartridge, which primer is a rim fire primer having an initiating rim of predetermined effective diameter.

In accordance with a third aspect of this invention, there is provided a pressure generating cartridge assembly including a pressure generating cartridge having a rim fire primer having an initiating rim of predetermined effective diameter, and a force amplifying initiating device as herein described, in which the force amplifying initiating device is located to a body of the pressure generating cartridge.

Said primer may be mounted in said fore opening of the body of the initiating device and said initiating device may be located within a body of the cartridge at a rear end of the cartridge.

By way of development, said fore opening of the body of the initiating device may be in the form of a collar within which the primer is embraced.

Said fore point of the firing pin may be in alignment with a central portion of the rim fire primer within said initiating rim.

The initiating device may be formed of an assembly of synthetic polymeric mouldings.

Figure 2:
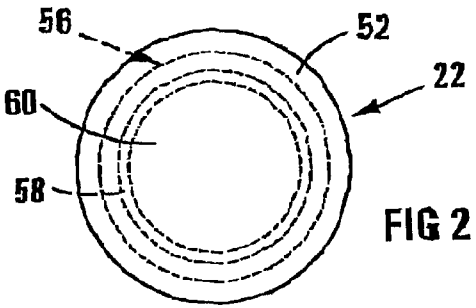

The invention is now described by way of example with reference to the accompanying diagrammatic drawings. In the drawings FIG. 1 shows, in axial section, a cartridge assembly in accordance with the invention; and FIG. 2 shows, in rear view, a primer of the cartridge assembly of FIG. 1.

With reference to the drawings, a cartridge assembly in accordance with the invention is generally indicated by reference numeral 10. The cartridge 10 is a pressure generating cartridge intended for "down the hole" application. In use, it will be placed at or near the bottom of a hole drilled into rock or the like. Preferably, the hole is filled with an incompressible fluid medium such as water, gel, or the like. A pressure pulse or shock wave is generated in the hole, for example at a mouth of the hole. Such pressure pulse or shock wave may, for example, be generated by firing of a blank cartridge. The shock wave or pressure pulse is propagated into the hole via the propagating medium. As will be explained below, one end of the cartridge assembly 10 is exposed to such shock wave or pressure pulse to cause a force amplifying initiating device 20 to be actuated to initiate a primer to fire the cartridge assembly 10.

The cartridge assembly 10 includes a shell generally indicated by reference numeral 12. One end of the shell, indicated by reference numeral 14, which is also a fore end of the cartridge 10, is closed. Toward a rear end of the shell 12, it is open.

The shell 12 is generally round cylindrical and contains a propellant 19.

The force amplifying initiating device 20 in accordance with the invention is mounted within the rear end 16 of the shell 12.

In accordance with the invention, a primer 22 is held within the initiating device 20 as will be described hereinafter, to be in operative association with the propellant 19 such that, when the primer 22 is initiated, the propellant 19 is fired.

The initiating device 20 includes a body 24 which is of generally annular cylindrical form having a round cylindrical outer periphery 26 and an inner cavity generally indicated by reference numeral 28. The outer periphery 26 is frictionally received within a rear portion 18 of the shell 12.

The cavity 28 has a central, generally parallel, round cylindrical portion. At a rear end of the cavity, the cavity is outwardly stepped into a round cylindrical socket which is open ended at its rear and which is generally indicated by reference numeral 30. The socket 30 is of shallow depth.

Forward of the central parallel portion, the wall of the cavity 28 tapers slightly as indicated by reference numeral 32 and, downstream of the taper portion 32, a constriction or collar 34 is formed embracing the primer 22.

The primer 22 has a round body 56 and, at a rear thereof, a peripheral flange 52 acting as a checking formation such that the primer 22 can be pressed home into the inner cavity 28, the flange 52 checking against the collar 34. The body 56 of the primer 22 then projects beyond the body 24 of the initiating device 20. At the fore end it has an opening 54 which is in communication with the propellant 19. The opening cannot be seen in the drawing, and reference numeral 54 merely indicates its position. FIG. 2 shows that the primer 22 has, proximate its outer periphery, an initiating rim 58 via which the primer is initiated. A central portion 60 is formed within the initiating rim 58. The primer 22 cannot be initiated by striking only the central portion 60.

Within the inner cavity 28, there is provided a firing pin body 40. At a rear of the body 40, it is integral with a rearwardly and radially outwardly stepped annular checking flange 42. A shallow round cylindrical socket 44 is formed inwardly of the flange 42 and rearwardly of the body 40. A narrow annular neck formation 46 interconnects the checking flange 42 and the body 40. A length of the checking flange 42 corresponds with the depth of the outwardly stepped socket 30 of the body 24 such that a rear face of the checking flange 42 is flush and planar with a rear annular face 38 of the body 24.

Toward a fore end of the firing pin body 40, it tapers sharply from a base which, in this embodiment, coincides with the periphery of the body 40, i.e. the fore end is conical as indicated by reference numeral 48 and terminates in a slightly rounded nose 50. In this embodiment, the included angle of the conical portion is 72°.

When the rear end of the cartridge 10 is subjected to a pressure pulse or shock wave, the pressure pulse or shock wave acts via the socket 44 to drive the firing pin body 40 forward. The checking flange 42 is checked in the socket 30 which causes the annular neck 46 to sever thus allowing the firing pin body 40 to shoot forward. It is to be appreciated that the annular neck 46 is designed such that a predetermined minimum pressure pulse or shock wave is required to actuate the initiating device 20.

When the firing pin body 40 shoots forward, the nose 50 impinges on a rear of the primer 22, more specifically on the central portion 60. In accordance with the invention, the primer 22 is a rim fire primer. Thus, it is initiated only when the firing pin body 40 impinges with enough force to deform the rear of the primer 22 and with enough speed to initiate the rim fire primer, by impinging on the initiating rim 58.

Because of the conicity 48 of the firing pin 40, the initiating rim 58 is struck a glancing blow. Because of the nature of the composition of the initiating rim, striking at high speed is required to cause initiation. It is important to appreciate that the construction and arrangement of the firing pin are such that the initiating rim will not be struck a direct blow.

When the primer 22 is initiated, its body in front of the collar 34 flares open while it fires the propellant 19 via the opening 54. Such flaring open is important in the context of this invention and will be emphasized hereinafter.

The Applicant has found that the use of a rim fire primer has important advantages over a center fire primer which has been known to and used by the applicant previously. As mentioned above, a rim fire primer requires both sufficient deformation and sufficiently high speed of deformation to be initiated. Thus, the Applicant has found that, even though the firing pin body 40 can inadvertently be actuated, for example by mechanical impact such as when a live cartridge is drilled upon when a further hole is to be drilled, such mechanical impact, for example drilling, does not cause deformation at sufficiently high speed to initiate the primer, Inter alia because the point 50 of the firing pin is aligned with the central portion 60 which is incapable of causing initiation, and the conical portion 40 strikes the initiating rim a glancing blow. Thus, although the primer can reliably be initiated by means of an appropriate shock wave or pressure pulse, it is relatively insensitive to mechanical actuation. This is a very important safety feature.

Furthermore, specifically a rim fire primer flares open when initiated thus causing the primer to remain locked within or secured within the collar 34 and thus within the initiating device 20. The primer 22 can thus not be propelled rearwardly out of the initiating device. It is thus of importance that the primer is embraced or banded in an annular area proximate the checking flange, that the body of the primer forward of the collar 34 is unrestricted to allow dilation, and that the collar 34 checks the dilated portion to prevent the primer from being propelled rearwardly out of the cartridge when the cartridge is fired. This is of great significance in that that feature enables the initiating device 20 and thus also the cartridge 10 to be classified appropriately to allow transport by passenger aeroplanes. In contrast, the Applicant has found that a centre fire primer, when initiated, does not generally lock within the initiating device body and is thus prone to be propelled rearwardly away from the cartridge 10. This prevents classification of the cartridge 10 into a suitable class such as to allow the cartridge 10 to be transported by means of a passenger aeroplane. It is to be noted that it is a large advantage if transport by means of passenger aeroplane can take place, both in respect of availability of flights and cost. It is also more convenient that transport by means of a cargo aeroplane.

What is claimed is:

1. A combination of a force amplifying initiating device and a primer of a cartridge, in which the primer is a rimfire primer having an initiating rim of predetermined effective diameter surrounding an inactive central portion, the initiating device comprising an open ended body having a fore opening within which the primer is operatively centrally mounted and a rear opening and a locating formation for locating the body to a cartridge to position the primer in a predetermined operative relation to the cartridge;

a firing pin having a fore operative end and a read end, and being movably contained in the body such that said fore operative end is in central alignment with the primer via said fore opening of the body and such that said rear end is exposed via said rear opening of the body, in which said fore operative end tapers from a rear base to a fore point, the rear base having a transverse dimension at least equal to the effective diameter of the initiating rim of the primer and the fore point having a transverse dimension smaller than the effective diameter of the initiating rim of the primer, the fore point being in alignment with said inactive central portion of the primer.

2. A combination as claimed in claim 1 in which the fore operative end of the firing pin is round, said transverse dimension of the base being the diameter of the base, and the transverse dimension of the point being the diameter of the point, said taper of the fore operative end of the firing pin being continuous or uninterrupted.

3. A combination as claimed in claim 1 in which the fore operative end of the firing pin is generally conical, said transverse dimension of the base being a diameter of the base, the fore point being rounded.

4. A combination as claimed in claim 3 in which an included angle of the generally conical fore operative end is between 160° and 40°.

5. A combination as claimed in claim 4 in which an included angle of the generally round conical operative fore end is between 100° and 60°.

6. A pressure generating cartridge assembly including a pressure generating cartridge and a combination as claimed in claim 1, in which the force amplifying initiating device is located to a body of the pressure generating cartridge, the primer being in said predetermined operative relation to said pressure generating cartridge.

7. A pressure generating cartridge assembly as claimed in claim 6 in which said initiating device is located within a body of the cartridge at a rear end of the cartridge.

8. A pressure generating cartridge assembly as claimed in claim 7, in which said fore opening of the body of the initiating device is in the form of a collar within which the primer is embraced, a fore portion of a body of the primer extending beyond said collar to allow said body to dilate beyond said collar.

* * * * *